US009280079B1

(12) United States Patent
Hoshio et al.

(10) Patent No.: US 9,280,079 B1
(45) Date of Patent: Mar. 8, 2016

(54) CHARGING MEMBER, PROCESS CARTRIDGE, AND IMAGE FORMING APPARATUS

(71) Applicant: FUJI XEROX CO., LTD., Tokyo (JP)

(72) Inventors: Takuro Hoshio, Kanagawa (JP); Taketoshi Hoshizaki, Kanagawa (JP); Hiroyuki Miura, Kanagawa (JP); Kosuke Narita, Kanagawa (JP); Jiro Korenaga, Kanagawa (JP); Yasuhiro Niida, Kanagawa (JP); Yoshiyuki Hayashi, Kanagawa (JP); Yasuhiko Kinuta, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/845,815

(22) Filed: Sep. 4, 2015

(30) Foreign Application Priority Data

Mar. 20, 2015 (JP) ..... 2015-058264

(51) Int. Cl.
*G03G 15/02* (2006.01)

(52) U.S. Cl.
CPC ..... *G03G 15/0233* (2013.01); *G03G 2215/021* (2013.01)

(58) Field of Classification Search
CPC . G03G 15/0216; G03G 15/0233; F16C 13/00
USPC ..... 399/176
See application file for complete search history.

(56) References Cited

U.S. PATENT DOCUMENTS

| | | | | |
|---|---|---|---|---|
| 7,366,448 | B2 * | 4/2008 | Taniguchi et al. | 399/176 |
| 2006/0275598 | A1 * | 12/2006 | Shimamura et al. | 428/323 |
| 2010/0104316 | A1 | 4/2010 | Hoshio et al. | |
| 2010/0142998 | A1 * | 6/2010 | Furukawa et al. | 399/176 |
| 2010/0247149 | A1 | 9/2010 | Hoshio | |
| 2011/0044725 | A1 * | 2/2011 | Mayuzumi et al. | 399/176 |
| 2011/0305481 | A1 * | 12/2011 | Taniguchi et al. | 399/115 |
| 2012/0213553 | A1 | 8/2012 | Hoshio | |
| 2013/0170860 | A1 * | 7/2013 | Martinkovic et al. | 399/176 |
| 2013/0302064 | A1 * | 11/2013 | Furukawa et al. | 399/111 |

FOREIGN PATENT DOCUMENTS

| | | | |
|---|---|---|---|
| JP | 2005-345801 | A | 12/2005 |
| JP | 2008-276024 | A | 11/2008 |
| JP | 2009-009044 | A | 1/2009 |
| JP | 2009-009045 | A | 1/2009 |
| JP | 2010-102197 | A | 5/2010 |
| JP | 2010-231103 | A | 10/2010 |
| JP | 2012-173360 | A | 9/2012 |

* cited by examiner

*Primary Examiner* — Benjamin Schmitt
(74) *Attorney, Agent, or Firm* — Oliff PLC

(57) ABSTRACT

A charging member includes a conductive base material and a conductive outermost layer provided on the conductive base material, wherein the conductive outermost layer has a ten-point average surface roughness Rz of 2 μm to 20 μm and contains a resin and particles in which particles having a particle diameter of 5.0 μm or more and a circularity of 0.8 or less are 30% by number or less with respect to the total number of particles having a particle diameter of 5.0 μm or more and particles having a particle diameter of less than 5.0 μm and a circularity of 0.8 or less are from 20% by number to 80% by number with respect to the total number of particles having a particle diameter of less than 5.0 μm.

14 Claims, 4 Drawing Sheets

CHARGING MEMBER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2015-058264 filed Mar. 20, 2015.

BACKGROUND

1. Technical Field

The present invention relates to a charging member, a process cartridge, and an image forming apparatus.

2. Related Art

In an image forming apparatus which uses an electrophotographic method, first, charging is performed by using a charging device on a surface of an image holding member which is configured of a photoconductive photoreceptor made of an inorganic or organic material, a latent image is formed, and then, the latent image is developed by a charged toner, and a visualized toner image is formed. In addition, a target image is formed by transferring the toner image to a recording medium, such as a recording sheet, via an intermediate transfer member or directly, and fixing the transferred image to the recording medium.

SUMMARY

According to an aspect of the invention, there is provided a charging member including:

a conductive base material; and a conductive outermost layer provided on the conductive base material, wherein the conductive outermost layer has a ten-point average surface roughness Rz of 2 μm to 20 μm and contains a resin and particles in which particles having a particle diameter of 5.0 μm or more and a circularity of 0.8 or less are 30% by number or less with respect to the total number of particles having a particle diameter of 5.0 μm or more, and particles having a particle diameter of less than 5.0 μm and a circularity of 0.8 or less are from 20% by number to 80% by number with respect to the total number of particles having a particle diameter of less than 5.0 μm.

BRIEF DESCRIPTION OF THE DRAWINGS

Exemplary embodiments of the present invention will be described in detail based on the following figures, wherein.

DETAILED DESCRIPTION

Figure 1:
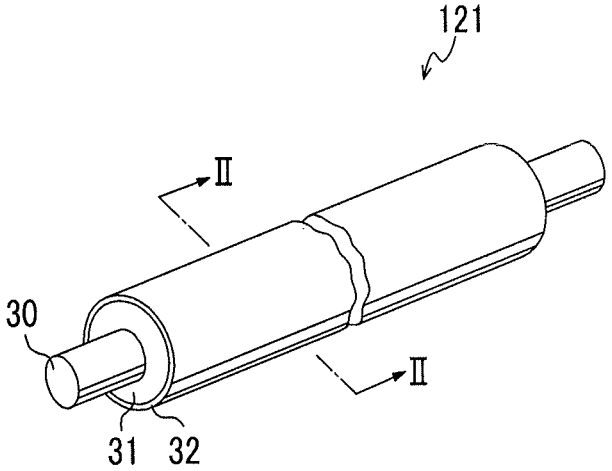
FIG. 1 is a perspective view schematically illustrating a charging member according to an exemplary embodiment.

Hereinafter, an exemplary embodiment which is an example of the present invention will be described.

Charging Member

A charging member according to the exemplary embodiment of the present invention includes a conductive base material, and a conductive outermost layer which is provided on the conductive base material, and has a ten-point average surface roughness Rz of 2 μm to 20 μm. In addition, the outermost layer contains a resin and particles (hereinafter, for convenience, referred to as "unevenness-imparting particles"), and among unevenness-imparting particles, particles having a particle diameter of 5.0 μm or more and a circularity of 0.8 or less are 30% by number or less with respect to the total number of particles having a particle diameter of 5.0 μm or more, and particles having a particle diameter of less than 5.0 μm and a circularity of 0.8 or less are from 20% by number to 80% by number with respect to the total number of particles having a particle diameter of less than 5.0 μm.

The charging member according to the exemplary embodiment is, for example, a charging member which is provided being in contact with or proximate to a member to be charged (for example, an image holding member), and charges the member to be charged by applying a voltage.

In addition, conductivity in the present specification means that a volume resistivity at 20° C. is $1\times10^{14}$ Ωcm or less.

Here, when the conductive outermost layer of the charging member includes the unevenness-imparting particles, unevenness is imparted onto a surface of the conductive outermost layer, and surface properties of the conductive outermost layer is adjusted in a ten-point average surface roughness Rz in a range of 2 μm to 20 μm, a stripe-shaped image defect is prevented. However, when the charging member is repeatedly used, there is a case where the surface of the conductive outermost layer of a charging member is contaminated, for example, by external additives of toner, paper powder, or discharge products, and a stripe-shaped image defect is formed.

In contrast to this, in the charging member according to the exemplary embodiment, as the unevenness-imparting particles, unevenness-imparting particles in which deformed particles and spherical particles having the above-described particle diameter and circularity are present together at a specific ratio are employed. According to this, even after the charging member is repeatedly used from the beginning, generation of the stripe-shaped image defect is prevented. The reason thereof is not clear, but it is assumed that, when unevenness is imparted onto the surface of the conductive outermost layer by the unevenness-imparting particles in which the deformed particles and the spherical particles having the above-described particle diameter and circularity are present together at a specific ratio, for example, external additives of toner, paper powder, or discharge products are unlikely to be fixed.

In particular, when a charging method of applying only a DC voltage to the charging member is employed, due to this charging method, generation of a stripe-shaped image defect remarkably easily occurs since uniform charging property is low, compared to a charging method of applying an AC voltage. However, in the charging member according to the exemplary embodiment, even when the charging method of applying only a DC voltage to the charging member is employed, even after the charging member is repeatedly used from the beginning, generation of a stripe-shaped image defect is prevented.

Hereinafter, the charging member according to the exemplary embodiment will be described with reference to the drawings.

Figure 2:
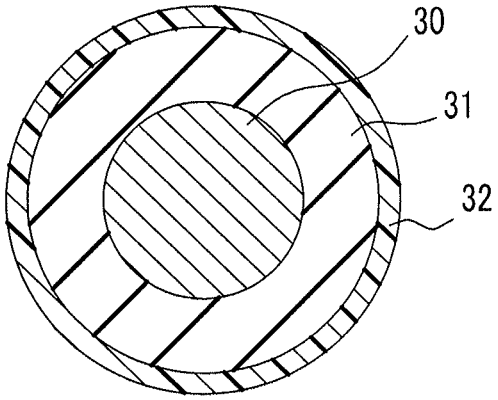
FIG. 2 is a sectional view schematically illustrating the charging member according to the exemplary embodiment.

FIG. 1 is a perspective view schematically illustrating the charging member according to an exemplary embodiment. FIG. 2 is a sectional view schematically illustrating the charging member according to the exemplary embodiment. In addition, FIG. 2 is a sectional view cut along line II-II in FIG. 1.

As shown in FIGS. 1 and 2, a charging member 121 according to the exemplary embodiment is, for example, a roll member which includes a cylindrical or columnar conductive base material 30, a conductive elastic layer 31 which is installed on an outer circumferential surface of the conductive base material 30, and a conductive outermost layer 32 which is installed on an outer circumferential surface of the conductive elastic layer 31.

In addition, here, a shape of the roll member is described as an example, but the shape of the charging member is not particularly limited, and a shape of a roll and a shape of a belt (tube) may be employed. Among these, as the charging member according to the exemplary embodiment, the member having a shape of a roll is preferable. In other words, it is preferable that the charging member is a charging roll.

A configuration of the charging member 121 according to the exemplary embodiment is not limited to the description above, and for example, a configuration in which the conductive elastic layer 31 is not provided, or a configuration in which an intermediate layer (for example, an adhesive layer) installed between the conductive elastic layer 31 and the conductive base material 30, and a resistance controlling layer or a transition preventing layer installed between the conductive elastic layer 31 and the conductive outermost layer 32 are provided, may be employed. In addition, the charging member 121 according to the exemplary embodiment may be configured of the conductive base material 30 and the conductive outermost layer 32.

Hereinafter, each layer of the charging member 121 according to the exemplary embodiment will be described in detail.

Conductive Base Material

The conductive base material 30 will be described.

Examples of a material having a conductivity which configure the conductive base material 30 include metal or an alloy (e.g., aluminum, a copper alloy, and stainless steel), iron which is subjected to a plating treatment with chrome or nickel, and a conductive resin.

The conductive base material 30 functions as an electrode of a charging roll and a supporting member, and examples of the material thereof include metal, such as iron (free-cutting steel or the like), copper, brass, stainless steel, aluminum, and nickel. Examples of the conductive base material 30 include members (for examples, resins or ceramic members) of which the outer circumferential surface has undergone a plating process; members (for example, resins or ceramic members) in which a conductive material has dispersed; and the like. The conductive base material 30 maybe a hollow member (cylindrical member) or a non-hollow member.

Conductive Elastic Layer

The conductive elastic layer 31 will be described.

The conductive elastic layer 31 contains, for example, an elastic material and a conductive material. The conductive elastic layer 31 may contain other additives as necessary.

Examples of an elastic materials include isoprene rubber, chloroprene rubber, epichlorohydrin rubber, isobutylene-isoprene rubber, polyurethane, silicone rubber, fluororubber, styrene-butadiene rubber, butadiene rubber, nitrile rubber, ethylene propylene rubber, epichlorohydrin-ethylene oxide copolymer rubber, epichlorohydrin-ethylene oxide-allyl glycidyl ether copolymer rubber, ethylene-propylene-diene ternary copolymer rubber (EPDM), acrylonitrile-butadiene copolymer rubber (NBR), natural rubber, and blend rubber using these types of rubber. Among these, as the elastic material, it is preferable to use polyurethane, silicone rubber, EPDM, epichlorohydrin-ethylene oxide copolymer rubber, epichlorohydrin-ethylene oxide-allyl glycidyl ether copolymer rubber, NBR, and the blend rubber using these types of rubber. These elastic materials may be foamed or may be non-foamed.

Examples of the conductive material include an electron conductive material and anion conductive material. Examples of the electron conductive material include powders of carbon black such as ketjen black and acetylene black; pyrolytic carbon, graphite; various conductive metals or alloys such as aluminum, copper, nickel, and stainless steel; various conductive metal oxides such as tin oxide, indium oxide, titanium dioxide, tin oxide-antimony oxide solid solution, and tin oxide-indium oxide solid solution; and insulating materials of which the surface is subjected to a conductive treatment. Examples of the ion conductive material include perchlorates and chlorates of tetraethyl ammonium and lauryl trimethyl ammonium; alkali metal such as lithium and magnesium, and perchlorates and chlorates of alkali earth metal. These conductive materials may be used singly or in a combination of two or more.

Here, specifically, examples of carbon black include "Special Black 350", "Special Black 100", "Special Black 250", "Special Black 5", "Special Black 4", "Special Black 4A", "Special Black 550", "Special Black 6", "Color Black FW200", "Color Black FW2", or "Color Black FW2V", manufactured by Degussa Corporation, and "MONARCH 1000", "MONARCH 1300", "MONARCH 1400", "MOGUL-L", or "REGAL 400R", manufactured by Cabot Corporation.

An average particle diameter of the conductive material is preferably from 1 nm to 200 nm.

In addition, the average particle diameter is calculated by observing the conductive material with an electronic microscope, measuring diameters (maximum diameters) of 100 particles of the conductive material, and averaging the measured diameters, by using samples obtained by cutting out the conductive elastic layer 31. In addition, the average particle diameter may be measured, for example, by using a Zetasizer Nano ZS manufactured by Sysmex Corporation.

A content of the conductive material is not particularly limited, but in a case of the above-described electron conductive material, the content is preferably in a range of 1 part by weight to 30 parts by weight, and more preferably in a range from 15 parts by weight to 25 parts by weight with respect to 100 parts by weight of the elastic material. Meanwhile, in a case of the above-described ion conductive material, a content is preferably in a range of 0.1 parts by weight to 5.0 parts by weight, and more preferably in a range of 0.5 parts by weight to 3.0 parts by weight with respect to 100 parts by weight of the elastic material.

Examples of other additives which are mixed into the conductive elastic layer 31 include a material which may be added to a general elastic layer, such as a softener, a plasticizer, a hardener, a vulcanizing agent, a vulcanization accelerator, an antioxidant, a surfactant, a coupling agent, or a filler (silica or calcium carbonate).

The conductive elastic layer 31 is, for example, formed on the outer circumferential surface of the adhesive layer by extruding a material for forming a conductive elastic layer together with the conductive base material 30, by using an extruder provided with a crosshead or the like.

The thickness of the conductive elastic layer 31 is preferably from 1 mm to 10 mm, and more preferably from 2 mm to 5 mm.

In addition, a volume resistivity of the conductive elastic layer 31 is preferably from $10^3$ Ωcm to $10^{14}$ Ωcm.

In addition, the volume resistivity of the conductive elastic layer 31 is a value which is measured by a method which will be described in the following.

A sheet-shaped measurement sample is collected from the conductive elastic layer 31, and a voltage which is adjusted so that an electric field (applied voltage/composition sheet thickness) becomes 1,000 V/cm is applied to the measurement sample for 30 seconds by using a measuring tool (R12702A/B resistivity chamber manufactured by Advantest Corporation) and high resistance measuring instrument (R8340A digital ultra high resistance/micro current meter manufactured by Advantest Corporation) following JIS K6911(1995). After this, the volume resistivity is calculated by using the following equation from the flowing current value.

Volume resistivity (Ωcm)=(19.63×applied voltage (*V*))/(current value (*A*)×thickness of measurement sample (cm))

Conductive Outermost Layer

The conductive outermost layer 32 contains a resin and unevenness-imparting particles. The conductive outermost layer 32 may include the conductive material and other additives, as necessary.

Ten-point Average Surface Roughness Rz

A ten-point average surface roughness Rz of the conductive outermost layer 32 is from 2 μm to 20 μm. The ten-point average surface roughness Rz of the conductive outermost layer 32 is preferably from 3 μm to 12 μm, more preferably from 4 μm to 10 μm, and still more preferably from 5 μm to 8 μm.

When the ten-point average surface roughness Rz of the conductive outermost layer 32 is 2 μm or more, contamination of the conductive outermost layer 32 is prevented, and generation of a stripe-shaped image defect is prevented. When the ten-point average surface roughness Rz of the conductive outermost layer 32 is 20 μm or less, external additives of toner, paper powder, or discharge products are less likely to stay at an uneven part on the surface of the conductive outermost layer 32, local abnormal discharge is prevented, and generation of image defect, such as a white spot, is easily prevented.

In addition, the ten-point average surface roughness Rz is surface roughness specified by JIS B0601(1994). The ten-point average surface roughness Rz is a value which is measured by using a contact type surface roughness measuring apparatus (Surfcom 570A manufactured by Tokyo Seimitsu Co., Ltd.) under an environment of 23° C. and 55 RH %. However, an average value of measurement repeated 3 times at different locations by setting a measurement distance to be 2.5 mm, and using a needle of which a tip end is a diamond (5 μm R, 90° of cone) as a contact needle, is the ten-point average surface roughness Rz.

Resin

Examples of the resin include acrylic resins, fluorine-modified acrylic resins, silicone-modified acrylic resins, cellulose resins, polyamide resins, copolyamide nylon, polyurethane resins, polycarbonate resins, polyester resins, polyimide resins, epoxy resins, silicone resins, polyvinyl alcohol resins, polyvinyl butyral resins, polyvinyl acetal resins, ethylene tetrafluoroethylene resins, melamine resins, polyethylene resins, polyvinyl resins, polyarylate resins, polythiophene resins, polyethylene terephthalate resins (PET), fluororesins (polyvinylidene fluoride resins, ethylene tetrafluoride resins, tetrafluoroethylene-perfluoroalkylvinyl ether copolymers (PFA), tetrafluoroethylene-hexafluoropropylene copolymers (FEP), or the like), and the like. In addition, examples of the resin include a resin which is made by hardening or cross-linking a hardening resin by a hardener or a catalyst. In addition, the resin may be an elastic material.

The copolymer nylon is a copolymer which contains one or plural kinds among nylon 610, nylon 11, and nylon 12 as a polymerization unit. Moreover, the copolymer nylon may contain other polymerization units such as nylon 6 and nylon 66.

Among these, from the viewpoint that the contamination of the conductive outermost layer 32 is prevented, and generation of a stripe-shaped image defect is likely to be prevented, as a resin, a polyvinylidene fluoride resin, a tetrafluoroethylene resin, and a polyamide resin are preferable, and a polyamide resin is more preferable. In the polyamide resin, frictional charging due to a contact with the member to be charged (for example, the image holding member) is less likely to occur, and adhesion of toner or external additives are likely to be prevented.

Examples of the polyamide resin include a polyamide resin which is described in a Polyamide Resin Handbook, Fukumoto Osamu (published by Nikkan Kogyo Shimbun, Ltd.). Among these, in particular, as the polyamide resin, from the viewpoint that the contamination of the conductive outermost layer 32 is prevented, and generation of a stripe-shaped image defect is likely to be prevented, an alcohol-soluble polyamide resin is preferable, an alkoxymethylated polyamide (alkoxymethylated nylon) resin is more preferable, and a methoxymethylated polyamide (methoxymethylated nylon) resin is still more preferable.

Unevenness-Imparting Particles

In the unevenness-imparting particles, particles having a particle diameter of 5.0 μm or more and a circularity of 0.8 or less are 30% by number or less with respect to the total number of particles having a particle diameter of 5.0 μm or more, and particles having a particle diameter of less than 5.0 μm and a circularity of 0.8 or less are from 20% by number to 80% by number with respect to the total number of particles having a particle diameter of less than 5.0 μm.

In addition, hereinafter, particles having a particle diameter of 5.0 μm or more and a circularity of 0.8 or less are called a "large diameter side deformed particles", particles having a particle diameter of 5.0 μm or more and a circularity of more than 0.8 and 1.0 or less are called "large diameter side spherical particles", particles having a particle diameter of less than 5.0 μm and a circularity of 0.8 or less are called "small diameter side deformed particles", and particles having a particle diameter of less than 5.0 μm and a circularity of more than 0.8 and 1.0 or less are called "small diameter side spherical particles".

Specifically, the unevenness-imparting particles contain the large diameter side particles having a particle diameter of 5.0 μm or more and the small diameter side particles having a particle diameter of less than 5.0 μm. Among the large diameter side particles having a particle diameter or 5.0 μm or more, a ratio of the large diameter side deformed particles to the total number of large diameter side particles is 30% by number or less, and a ratio of the large diameter side spherical particles to the total number of large diameter side particles is 70% by number or more. Meanwhile, among the small diameter side particles having a particle diameter of less than 5.0

μm, a ratio of the small diameter side deformed particles to the total number of small diameter side particles is from 20% by number to 80% by number, and a ratio of the small diameter side spherical particles to the total number of small diameter side particles is from 20% by number to 80% by number.

In other words, the unevenness-imparting particles have a circularity distribution in which a ratio of the large diameter side deformed particles is small and a ratio of the large diameter side spherical particles is large on the large diameter side, and a circularity distribution in which both the small diameter side deformed particles and the small diameter side spherical particles are present at a specific ratio on the small diameter side.

In the unevenness-imparting particles, from the viewpoint of preventing of generation of a stripe-shaped image defect, a ratio of the large diameter side deformed particles to the total number of large diameter side particles is preferably 20% by number or less. A lower limit value of a ratio of the large diameter side deformed particles is preferably 0% by number, and may be 5% by number.

Meanwhile, from the viewpoint of preventing generation of a stripe-shaped image defect, a ratio of the large diameter side spherical particles to the total number of large diameter side particles is preferably 80% by number or more. An upper limit value of a ratio of the large diameter side spherical particles is preferably 100% by number, and may be 95% by number.

In the unevenness-imparting particles, from the viewpoint of preventing generation of a stripe-shaped image defect, a ratio of the small diameter side deformed particles to the total number of small diameter side particles is preferably from 30% by number to 70% by number.

Meanwhile, from the viewpoint of preventing generation of a stripe-shaped image defect, a ratio of the small diameter side spherical particles to the total number of small diameter side particles is preferably from 30% by number to 70% by number.

In addition, a lower limit value of circularity of the large diameter side deformed particles and the small diameter side deformed particles is preferably 0.2, and more preferably 0.3.

Here, a ratio of each particle of the unevenness-imparting particles is a value calculated by the following method.

A measurement sample is cut out from the conductive outermost layer 32 of the charging member. In addition, a sectional surface of the measurement sample is observed by a scanning electron microscope (SEM), and image analysis is performed. The longest diameter and the shortest diameter of primary particles of the unevenness-imparting particles obtained by the image analysis are measured, and a sphere equivalent diameter is measured from an intermediate value thereof. The measurement of the sphere equivalent diameter is performed with respect to 100 primary particles of the unevenness-imparting particles.

Meanwhile, a circularity of the primary particles of the unevenness-imparting particles obtained by the image analysis is calculated by an equation. The calculation of the circularity is performed with respect to 100 primary particles of the unevenness-imparting particles.

$$\text{Circularity } (100/SF2)=4\pi\times(A/I^2) \qquad \text{Equation:}$$

[In the equation, I indicates a peripheral length of the primary particles of the unevenness-imparting particles on the image, and A indicates a projected area of the primary particles of the unevenness-imparting particles. SF2 indicates a shape factor.]

In addition, accordingly, a distribution of the particle diameter and circularity of the unevenness-imparting particles is obtained. From this distribution, a ratio of the large diameter side deformed particles to the total number of large diameter side particles having a particle diameter of 5.0 μm or more, and a ratio of the small diameter side deformed particles to the total number of the small diameter side particles having a particle diameter of less than 5.0 μm, are determined.

In addition, a ratio of each particle of the unevenness-imparting particles may be determined by collecting the unevenness-imparting particles, and directly observing the particles.

From the viewpoint of preventing generation of a stripe-shaped image defect, a number average particle diameter of the unevenness-imparting particles (all of the particles) is preferably from 2 μm to 20 μm, more preferably from 3 μm to 15 μm, and still more preferably from 3 μm to 12 μm.

From the viewpoint of preventing generation of a stripe-shaped image defect, a standard deviation of a particle diameter based on the number of unevenness-imparting particles is preferably from 1.2 to 7, more preferably from 1.5 to 5, and still more preferably from 1.5 to 3.

From the viewpoint of preventing generation of a stripe-shaped image defect, a coefficient of variation (CV) value of the unevenness-imparting particles is preferably from 30% to 95%, more preferably from 35% to 90%, and still more preferably from 40% to 85%.

Here, the number average particle diameter, the standard deviation of the particle diameter based on the number, and the CV value of the unevenness-imparting particles, are values measured by the following method.

First, the measurement sample is cut out from the conductive outermost layer 32 of the charging member. In addition, a sectional surface of the measurement sample is observed by a scanning electron microscope (SEM), and the image analysis is performed. The longest diameter and the shortest diameter of the primary particles of the unevenness-imparting particles obtained by the image analysis are measured, and a sphere equivalent diameter is measured from an intermediate value thereof. The measurement of the sphere equivalent diameter is performed with respect to 100 primary particles of the unevenness-imparting particles. 50% diameter (D50n) in a cumulative frequency based on the number of obtained sphere equivalent diameter of the primary particles of the unevenness-imparting particles is determined as the number average particle diameter of the unevenness-imparting particles.

In addition, the standard deviation of the particle diameter based on the number of the unevenness-imparting particles is calculated based on the particle diameter distribution based on the number obtained from the sphere equivalent diameter of the primary particles of the unevenness-imparting particles.

In addition, the CV value of the unevenness-imparting particles is calculated by the following equation from the obtained number average particle diameter and the standard deviation of the particle diameter based on the number of the unevenness-imparting particles.

$$\text{CV value } [\%]=(\sigma/D)\times 100 \quad (\sigma\text{: standard deviation of the particle diameter based on the number (μm), } D\text{: number average particle diameter (nm)}) \qquad \text{Equation:}$$

In addition, the number average particle diameter, the standard deviation of the particle diameter based on the number, and the CV value of the unevenness-imparting particles may be determined by collecting the unevenness-imparting particles, and directly observing the particles.

Examples of the unevenness-imparting particles include resin particles and inorganic particles. The unevenness-imparting particles may be porous particles, and may be non-porous particles. In addition, the unevenness-imparting particles may also function as a conductive material.

Examples of the resin particles include polyamide resin particles, polyimide resin particles, polyacrylic resin particles, polymethacrylic resin particles, polystyrene resin particles, fluororesin particles, and silicone resin particles.

Examples of the inorganic particles include carbon black, graphite, carbon particles obtained by sintering a phenol resin, metal particles, and metal oxide particles.

Among these, from the viewpoint of preventing generation of a stripe-shaped image defect, as the unevenness-imparting particles, the polyamide resin particles are preferable.

Examples of the polyamide resin particles include particles of the polyamide resin described in Polyamide Resin Handbook, Fukumoto Osamu (published by Nikkan Kogyo Shimbun, Ltd.). Among these, in particular, as the polyamide resin, from the viewpoint preventing generation of a stripe-shaped image defect, alcohol-soluble polyamide particles are preferable, alkoxy methylated polyamide particles (alkoxymethylated nylon particles) are more preferable, and a methoxymethylated polyamide particles (methoxymethylated nylon particles) are still more preferable.

Conductive Material, and Other Additives

As the conductive material, a conductive material which is similar to the conductive material mixed into the conductive elastic layer 31 is used. A number average particle diameter of the conductive material may preferably be smaller than the number average particle diameter of the unevenness-imparting particles.

In addition, examples of other additives include known additives, such as a conductive material, a softener, a plasticizer, a hardener, a vulcanizing agent, a vulcanization accelerator, an antioxidant, a surfactant, and a coupling agent.

Contents of Each Component

In the conductive outermost layer 32, a content of the resin may be from 20% by weight to 99% by weight (preferably from 10% by weight to 95% by weight), and a content of the unevenness-imparting particles maybe from 1% by weight to 50% by weight (preferably from 3% by weight to 45% by weight).

In addition, when the conductive material is included, the content of the resin may be from 20% by weight to 98% by weight (preferably from 10% by weight to 95% by weight), a content of the unevenness-imparting particles may be from 1% by weight to 50% by weight (preferably from 3% by weight to 45% by weight), and a content of the conductive material may be from 1% by weight to 50% by weight (preferably from 1% by weight to 30% by weight).

Forming Method of Conductive Outermost Layer

The conductive outermost layer 32 is formed, for example, by coating the conductive base material 30 (outer circumferential surface of the conductive elastic layer 31) with a coating liquid in which each of the above-described components are dissolved or dispersed in a solvent by a dipping method, a spray method, a vacuum evaporation method, or a plasma coating method, and by drying the formed coating film.

Conditions of drying is determined in accordance with a type and an amount of the resin or the catalyst, but a drying temperature is preferably from 40° C. to 200° C., and more preferably from 50° C. to 180° C.

Time for drying is preferably from 5 minutes to 5 hours, and more preferably from 10 minutes to 3 hours.

As means for drying, a hot air drying method or the like is employed.

In addition, from the viewpoint of preventing irregularity of the thickness of the conductive outermost layer 32 and a dispersed state of the unevenness-imparting particles, a solid content concentration in the coating liquid for forming the conductive outermost layer 32 is preferably from 5% by weight to 50% by weight.

Here, on the conductive outermost layer 32 (coating liquid for forming the conductive outermost layer 32), in order to accelerate hardening of the resin, a catalyst may be used. As a hardening catalyst, an acidcatalyst is used.

Examples of the acidcatalysts include aliphatic carboxylic acids (e.g., acetic acid, chloroacetic acid, trichloroacetic acid, trifluoroacetic acid, oxalic acid, maleic acid, malonic acid, and lactic acid); aromatic carboxylic acids (e.g., benzoic acid, phthalic acid, terephthalic acid, and trimellitic acid); and aliphatic or aromatic sulfonic acids (e.g., methanesulfonic acid, dodecyl sulfonic acid, benzene sulfonic acid, dodecyl benzene sulfonic acid, and naphthalene sulfonic acid).

Characteristics of Conductive Outermost Layer

The thickness of the conductive outermost layer 32 is, for example, preferably from 0.01 μm to 1,000 μm, and more preferably from 2 μm to 25 μm.

The thickness of the conductive outermost layer 32 is more preferably equal to or less than 1.7 times the number average particle diameter of the total number of particles. In addition, the thickness of the conductive outermost layer 32 is preferably equal to or greater than 0.5 times the number average particle diameter of the total number of particles.

As the thickness of the conductive outermost layer 32 is equal to or less than 1.7 times the number average particle diameter of the total number of unevenness-imparting particles, even after the charging member is repeatedly used from the beginning, generation of a stripe-shaped image defect is likely to be prevented. It is assumed that the reason why a stripe-shaped image defect is likely to be prevented is that overlap of the unevenness-imparting particles inside the conductive outermost layer 32 is small as the thickness of the conductive outermost layer 32 is equal to or less than 1.7 times the number average particle diameter of the total number of unevenness-imparting particles, a shape of the unevenness-imparting particles is likely to be reflected to the uneven state of the conductive outermost layer 32, and an excellent uneven state is made. In addition, it becomes easy to form a coating film of the excellent uneven state as the thickness of the conductive outermost layer 32 is equal to or greater than 0.5 times the number average particle diameter of the total number of unevenness-imparting particles.

A volume resistivity of the conductive outermost layer 32 is preferably from $10^3$ Ωcm to $10^{14}$ Ωcm.

In addition, the volume resistivity of the conductive outermost layer 32 is a value which is measured by the same method as that of the volume resistivity of the conductive elastic layer 31.

Charging Device

Hereinafter, a charging device according to the exemplary embodiment will be described.

Figure 3:
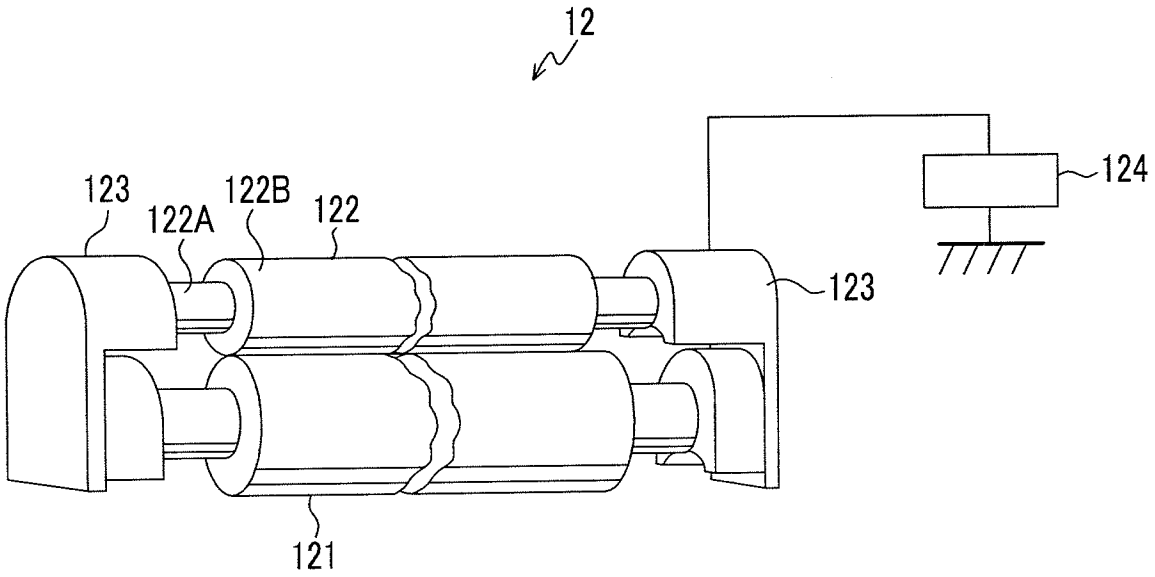
FIG. 3 is a perspective view schematically illustrating a charging device according to an exemplary embodiment.

FIG. 3 is a perspective view schematically illustrating the charging device according to the exemplary embodiment.

The charging device according to the exemplary embodiment is provided with the charging member. In addition, as a charging member, the charging member according to the above-described exemplary embodiment is employed.

Specifically, as shown in FIG. 3, in a charging device 12 according to the exemplary embodiment, for example, the charging member 121 and a cleaning member 122 are provided to contact with each other with certain deformation. In addition, both ends of the conductive base material 30 of the charging member 121 and a base material 122A of the cleaning member 122 in an axial direction are held by a conductive bearing 123 so that each member is freely rotatable. A power source 124 is connected to one end of the conductive bearing 123.

In addition, the charging device 12 according to the exemplary embodiment is not limited to the above-described configuration, and for example, may not be provided with the cleaning member 122.

Here, the charging device 12 according to the exemplary embodiment may preferably be a charging device which uses a contact or proximity charging method of applying a DC voltage to the charging member 121, and charging the surface of the member to be charged (for example, the image holding member). The applied voltage may be, for example, from positive or negative 50 V to positive or negative 2,000 V in accordance with a required charging potential of the member to be charged (for example, the image holding member).

In addition, the charging device 12 according to the exemplary embodiment may be a charging device which uses a contact or proximity charging method of applying an AC voltage or a voltage which is made by superimposing a DC voltage with an AC voltage to the charging member 121, and charging the surface of the member to be charged (for example, the image holding member).

The cleaning member 122 is a cleaning member for cleaning the surface of the charging member 121, and in the form of, for example, a roll. The cleaning member 122 is constituted with, for example, a cylindrical or columnar base material 122A and an elastic layer 122B provided on the outer circumferential surface of the base material 122A.

The base material 122A is a conductive rod-shaped member, and examples of the material thereof include metals such as iron (free-cutting steel or the like), copper, brass, stainless steel, aluminum, and nickel. Moreover, examples of the base material 122A include members (for examples, resins or ceramic members) of which the outer circumferential surface has undergone a plating process; members (for example, resins or ceramic members) in which a conductive material has dispersed; and the like. The base material 122A may be a hollow member (cylindrical member) or a non-hollow member.

The elastic layer 122B, preferably, is formed of a foam having a three-dimensional porous structure, has voids or unevenness (hereinafter, referred to as cells) in or on the surface thereof, and may have elasticity. The elastic layer 122B includes foamed resin materials or rubber materials such as polyurethane, polyethylene, polyamide, olefin, melamine or polypropylene, acrylonitrile-butadiene copolymer rubber (NBR), ethylene-propylene-diene copolymer rubber (EPDM), natural rubber, styrene-butadiene rubber, chloroprene, silicone, and nitrile.

Among the foamed resin materials and rubber materials, polyurethane having excellent tearing resistance and tensile strength maybe particularly suitably used so as to efficiently clean foreign substances such as toner or external additives by the driven frictional slide over the charging member 121, to make it difficult for the surface of the charging member 121 to be damaged due to the friction with the cleaning member 122, and to make it difficult to disconnect or break the elastic layer for a long period of time.

The polyurethane is not particularly limited, and examples thereof include reactants of polyols (such as polyester polyol, polyether polyol, and acrylpolyol) and isocyanates (such as 2,4-tolylene diisocyanate, 2,6-tolylene diisocyanate, 4,4-diphenylmethane diisocyanate, tolidine diisocyanate, and 1,6-hexamethylene diisocyanate) and reactants based on chain extenders thereof (such as 1,4-butanediol and trimethylolpropane). The polyurethane is typically foamed using a foaming agent (such as water or azo compounds (such as azodicarbonamide and azobisisobutyronitrile)).

The number of cells in the elastic layer 122B is preferably from 20/25 mm to 80/25 mm, more preferably from 30/25 mm to 80/25 mm, and particularly preferably from 30/25 mm to 50/25 mm.

The hardness of the elastic layer 122B is preferably from 100 N to 500 N, more preferably from 100 N to 400 N, and particularly preferably in the range of 150 N to 400 N.

The conductive bearings 123 are members holding the charging member 121 and the cleaning member 122 so as to be freely integrally rotatable and maintaining the inter-shaft distance therebetween. The conductive bearings 123 may have any material and shape, as long as the bearings are formed of a material having conductivity. Examples thereof include a conductive bearing or a conductive sliding bearing.

The power source 124 is a device that applies a voltage to the conductive bearings 123 to charge the charging member 121 and the cleaning member 122 to the same polarity and a known high-voltage power source device is used.

In the charging device 12 according to this exemplary embodiment, the charging member 121 and the cleaning member 122 are charged to the same polarity, for example, by applying a voltage to the conductive bearings 123 from the power source 124.

Image Forming Apparatus and Process Cartridge

An image forming apparatus according to the exemplary embodiment is provided with an image holding member, a charging device which charges a surface of the image holding member, a latent image forming device which forms a latent image on a charged surface of the image holding member, a developing device which develops the latent image formed on the surface of the image holding member by a toner to form a toner image, and a transfer device which transfers the toner image formed on the surface of the image holding member onto a recording medium. As the charging device, the charging device according to the exemplary embodiment is applied.

Meanwhile, a process cartridge according to the exemplary embodiment is detachable from, for example, the image forming apparatus having the above-described configuration, and is provided with the image holding member, and the charging device which charges the surface of the image holding member. In addition, as the charging device, the charging device according to the exemplary embodiment is applied. The process cartridge according to the exemplary embodiment, as necessary, may be provided with at least one device selected from a group which is configured of, for example, the latent image forming device which forms the latent image on the charged surface of the image holding member, the developing device which develops the latent image formed on the surface of the image holding member by the toner to form the toner image, the transfer device which transfers the toner image formed on the surface of the image holding member onto a recording medium, and a cleaning device which cleans the surface of the image holding member.

Here, the charging member of the charging device is provided being in contact with or proximate to a member to be charged. In other words, the charging device is provided in the image forming apparatus and the process cartridge as a charging device which uses a contact or proximity type charging method.

In addition, a case where the charging member is provided being proximate (proximity charging method) to the member to be charged indicates, for example, a case where the charging member is provided being separated from the surface of the image holding member within a range of 1 μm to 200 μm.

Figure 4:
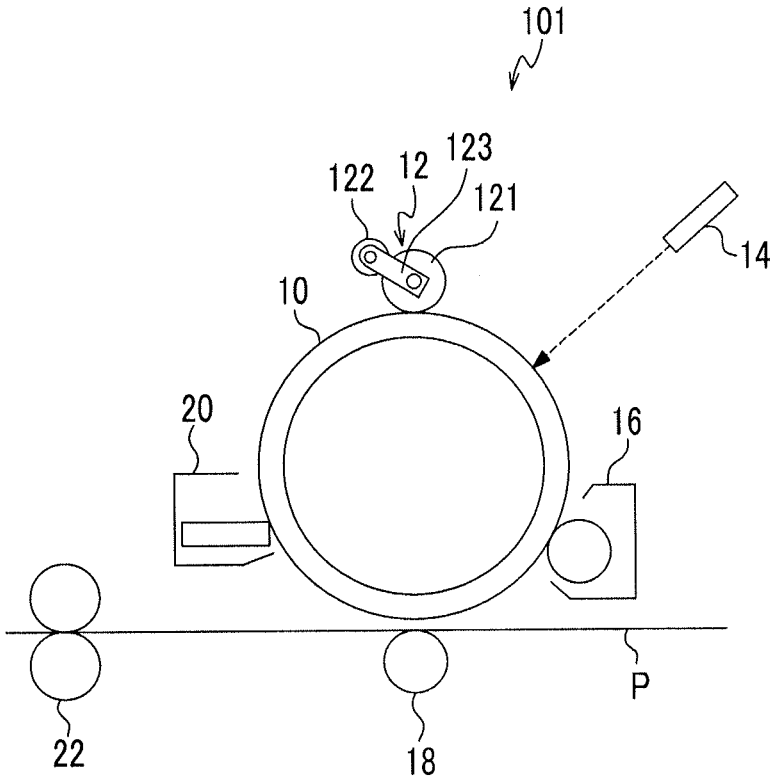
FIG. 4 is a diagram schematically illustrating the configuration of an image forming apparatus according to an exemplary embodiment.
Figure 5:
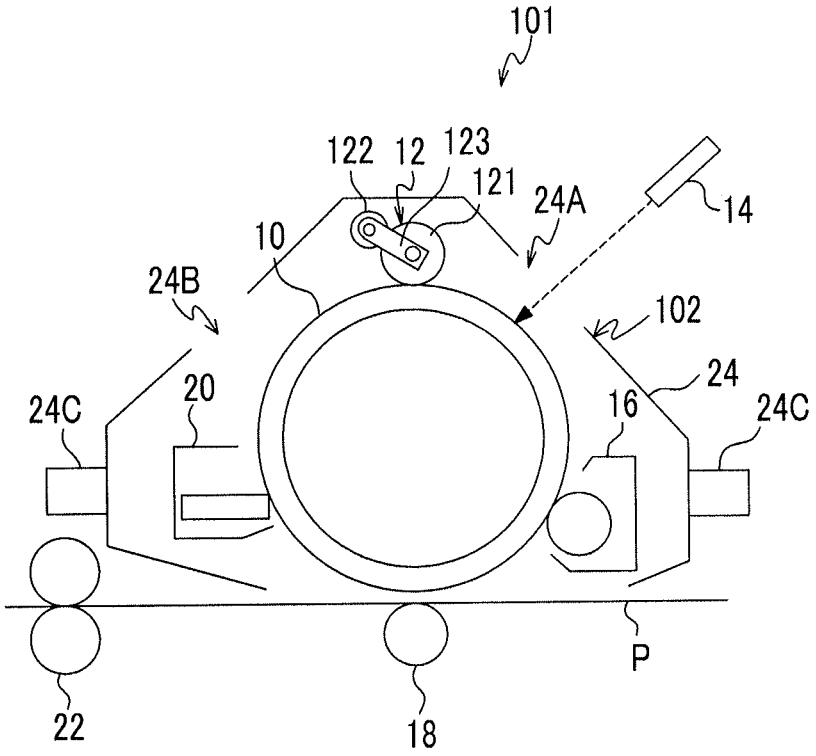
FIG. 5 is diagram schematically illustrating the configuration of a process cartridge according to an exemplary embodiment.

Next, the image forming apparatus and the process cartridge according to the present exemplary embodiment will be described with reference to drawings. FIG. 4 is a view schematically showing the configuration of the image forming apparatus according to the present exemplary embodiment. FIG. 5 is a view schematically showing the configuration of the process cartridge according to the present exemplary embodiment.

As shown in FIG. 4, the image forming apparatus 101 according to the exemplary embodiment includes an image holding member 10, and on the periphery thereof, the charging device 12 which charges the surface of the image holding member, an exposure device 14 which exposes the image holding member 10 charged by the charging device 12 to form the latent image, a developing device 16 which develops the latent image formed by the exposure apparatus 14 by the toner to form the toner image, and a transfer device 18 which transfers the toner image formed by the developing device 16 onto a recording medium P, and a cleaning device 20 which removes remaining toner on the surface of the image holding member 10 after the transferring, are provided. In addition, a fixing device 22 which fixes the toner image transferred onto the recording medium P by the transfer device 18 is provided.

The image forming apparatus 101 according to the exemplary embodiment employs as the charging device 12 the charging device according to the exemplary embodiment that is provided with the charging member 121, the cleaning member 122 arranged to contact with the charging member 121, the conductive bearings 123 (conductive bearings) holding both ends in the axis direction of the charging member 121 and the cleaning member 122 so as to be independently rotatable, and the power source 124 connected to one of the conductive bearings 123.

On the other hand, the image forming apparatus 101 according to this exemplary embodiment employs known constituent elements of the electrophotographic image forming apparatus of the related art as constituent elements other than the charging device 12 (the charging member 121). An example of each constitution element will be described below.

The image holding member 10 employs a known photoreceptor without any particular limitation, and a so-called functional separation type organic photoreceptor in which a charge generating layer and a charge transporting layer are separated is suitably used. The image holding member 10 of which the surface layer is coated with a protective layer having a charge transporting function and a cross-linking structure is also preferably applied. The photoreceptor having, as the cross-linking component of the protective layer, a siloxaneresin, a phenolresin, a melamine resin, a guanamine resin, or an acrylic resin, is also preferably applied.

As the exposure device 14, for example, a laser optical system or an LED array is employed.

For example, the developing device 16 is a developing device that allows a developer holding member having a developer layer formed on the surface thereof to contact with or to get close to the image holding member 10 and attaches the toner to the latent image on the surface of the image holding member 10 to form a toner image. Regarding the developing method of the developing device 16, a known developing method using a two-component developer is suitably used. Examples of the developing method using the two-component developer include a cascade method and a magnetic brush method.

For example, the transfer device 18 may employ any of a non-contact-type transfer method such as a corotron and a contact-type transfer method of bringing a conductive transfer roll into contact with the image holding member 10 through a recording medium P interposed therebetween and transferring the toner image to the recording medium P.

For example, the cleaning device 20 is a member which brings, for example, a cleaning blade into direct contact with the surface of the image holding member 10 to remove the toner, the paper powder, and the dust attached to the surface. As the cleaning device 20, a cleaning brush, a cleaning roll, or the like may be used other than the cleaning blade.

As the fixing device 22, a thermal fixing device using a heat roll is preferably used. For example, the thermal fixing device is configured of a fixing roller in which a heater lamp for heating is provided with inside of a cylindrical core bar, and a so-called release layer is formed by a heat resistant resin coating layer or a heat resistant rubber coating layer on the outer circumferential surface thereof, and a pressing roller or a pressing belt which are provided being in contact with the fixing roller at a certain contact pressure, and in which a heat resistant elastic layer is formed on the outer circumferential surface of the cylindrical core bar or a belt-shaped base material surface. For example, a process of fixing a non-fixed toner image is performed by causing the recording medium P on which a non-fixed toner image is transferred to pass between the fixing roller and the pressing roller or the pressing belt and fixing the toner image by thermally melting a binder resin, additives, and the like in the toner.

The image forming apparatus 101 according to the exemplary embodiment is not limited to the above-mentioned configuration and may be an intermediate transfer type image forming apparatus employing an intermediate transfer member or a so-called tandem type image forming apparatus in which image forming units forming toner images of respective colors are arranged in parallel.

As shown in FIG. 5, the process cartridge according to the present exemplary embodiment is a process cartridge 102 that integrally holds a combination of the image holding member 10, the charging device 12 that charges the image holding member, the developing device 16 that develops a latent image formed by the exposure device 14 with a toner to form a toner image, and the cleaning device 20 that removes the toner remaining on the surface of the image holding member 10 after the image is transferred, in the image forming apparatus shown in FIG. 4 by using a housing 24 including an opening portion 24A for exposure, an opening portion 24B for erasing exposure, and a mounting rail 24C. Moreover, the process cartridge 102 is detachably mounted on the image forming apparatus 101 shown in FIG. 4.

EXAMPLE

Hereinafter, the present invention will be described in more detail based on examples, but the present invention is not limited to the following examples. In addition, "parts" means "parts by weight" insofar as there is no particular remark otherwise stated.

Preparation of Unevenness-Imparting Particles

Unevenness-Imparting Particles (1) to (6)

Particles of the nylon 12 (polyamide resin particles) are obtained by the following operations.

A mixture which is obtained by mixing 5% by weight of a pellet-shaped resin of the nylon 12 into propylene glycol is stirred for approximately 30 minutes at 190° C. until the nylon 12 is completely dissolved in a mixing vessel to which a stirrer is attached and in which inside thereof is substituted with carbon dioxide. The obtained solution is cooled at a speed of 5° C./minute. In the cooling process, approximately 80% of the entire content are granulated as a monocyteshaped nylon 12, but remaining approximately 20% are precipitated in a lump-form. After removing the lump-shaped precipitate in the mixture, roughly separating the solvent by centrifugal separation, and drying the material, the particles of the nylon 12 are obtained. When the obtained particles of the nylon 12 are observed by a microscope, particles having 10 μm or less in size which make up most of the particles, and additionally, spherical particles in a range of 30 μm into 40 μm, are confirmed. In addition, as a result of confirming a particle diameter and a distribution of the obtained particles of the nylon 12 by a particle distribution measuring device, a number average particle diameter of the particles of the nylon 12 is 20 μm. Furthermore, by processing the obtained particles of the nylon 12 for 30 minutes by using a ball mill, particles of the nylon 12 having a number average particle diameter of 10 μm is obtained.

Next, the obtained particles of the nylon 12 (polyamide resin particles) are classified, and plural classified products of the particles of the nylon 12 which have different particle diameters and circularities are obtained. In addition, the plural classified products of the particles of the nylon 12 are combined and mixed with each other, and the unevenness-imparting particles (1) to (6) having characteristics shown in Table 1 are obtained.

Unevenness-Imparting Particles (7): Polymethacrylic Resin Particles (PMMA)

Polymethacrylic resin particles are obtained by the following operations.

Polymethacrylic particles (Techno Polymer MBX-20 manufactured by Nippon Shokubai Co., Ltd) are put into a ball mill, and processed for 30 minutes. A number average particle diameter thereof is 10 μm.

Next, the obtained polymethacrylic resin particles are classified, and plural classified products of the polymethacrylic resin particles which have different particle diameters and circularities are obtained. In addition, the plural classified products of the polymethacrylic resin particles are combined and mixed with each other, and the unevenness-imparting particles (7) having characteristics shown in Table 1 are obtained.

Unevenness-Imparting Particles (8): Silica Particles (Silica)

As silica particles, Sunsphere H-51 manufactured by AGC Si-Tech Co., Ltd. and VX-S2 manufactured by Tatsumori Ltd. are mixed with each other at an arbitrary ratio, and the unevenness-imparting particles (8) having characteristics shown in Table 1 are obtained.

Comparative Unevenness-Imparting Particles (C1) to (C5)

The plural classified products of the polyamide resin particles in the preparation of the unevenness-imparting particles (1) to (6) are combined and mixed with each other, and comparative unevenness-imparting particles (C1) to (C5) having characteristics shown in Table 1 are obtained.

Example 1

Preparation of Base Material

A conductive base material having a diameter of 8 mm is obtained by performing electroless nickel-plating of thickness of 5 μm with respect to a base material made of SUM23L and then performing a treatment with hexavalent chromic acid.

Formation of Adhesive Layer

Next, after mixing the following mixture for 1 hour by using a ball mill, an adhesive layer having a film thickness of 20 μm is formed on the surface of the base material by brush coating.

- Chlorinated polypropylene resin (maleic anhydride chlorinated polypropylene resin: Super Chlon 930 manufactured by Nippon Paper Industries Co., Ltd.): 100 parts
- Epoxy resin (EP4000 manufactured by ADEKA Corporation): 10 parts
- Conductive material (carbon black Ketjenblack EC manufactured by Ketjenblack International Co.): 2.5 parts In addition, toluene or xylene is used in adjusting viscosity.

Formation of Conductive Elastic Layer

The mixture having the following composition is kneaded by an open roll, the mixture is extruded onto the surface of the base material on which the adhesive layer is formed, and an elastic layer is formed by using a molding machine, and vulcanized. At this time, an external dimension of a transporting path of the base material (shaft) is 8 mmϕ, and a base material having an outer diameter of 8 mmϕ and a length of 350 mm is used as the base material. In addition, as a crosshead extrusion device, a 40 mm extruder manufactured by Mitsuba Mfg. Co., Ltd., and a crosshead die having an inner diameter of a die nozzle of 13 mmϕ are used.

- Rubber material (epichlorohydrin ethylene oxide allyl glycidyl ether copolymer rubber Gechron3106 manufactured by Zeon Corporation): 100 parts
- Conductive material (carbon black Asahi thermal manufactured by Asahi Carbon Co., Ltd.): 15 parts
- Conductive material (Ketjenblack EC manufactured by Ketjenblack International Co.): 5 parts
- Ion conductive material (lithium perchlorate): 1 part
- Vulcanizing agent (sulfur 200 mesh manufactured by Tsurumi Chemical Industry Co., Ltd.): 1 part
- Vulcanization accelerator (Nocceler DM manufactured by Ouchi Shinko Chemical Industrial Co., Ltd.): 2.0 parts
- Vulcanization accelerator (Nocceler TT manufactured by Ouchi Shinko Chemical Industrial Co., Ltd.): 0.5 parts
- Vulcanization accelerator aid (zinc oxide, zinc oxide of JIS 1 grade manufactured by Seido Chemical Industry Co., Ltd.): 3 parts
- Stearic acid: 1.5 parts Formation of Conductive Outermost Layer

- Resin (N-methoxymethylated nylon: F30K manufactured by Nagase ChemteX Corporation): 100 parts
- Unevenness-imparting particles (1): 30 parts
- Conductive material (carbon black MONAHRCH 1000 manufactured by Cabot Corporation, volume average particle diameter: 43 nm): 17 parts
- Catalyst ("Nacure4167" manufactured by King Industries Inc.): 4.4 parts A dispersion is obtained by diluting the mixture having the above composition with methanol, and performing dispersing by using a bead mill. With the dispersion, dipping-coating of the surface of the conductive elastic layer is performed, drying by heating for 30 minutes at 180° C. is performed to form a surface layer having a thickness of 7 μm, and thus a charging member (charging roll) is obtained.

Examples 2 to 11

Each charging member (charging roll) is obtained in the same manner as in Example 1, except that a type of resin, and a type and an amount of unevenness-imparting particles in composition of the conductive outermost layer are changed in accordance with Table 1.

Example 12

A charging member (charging roll) is obtained in the same manner as in Example 1, except that the resin in the composition of the conductive outermost layer used in Example 1 is changed to an acrylic resin formulation having the following composition.

Acrylic Resin Formulation

Resin (Desmophen A450BA manufactured by Sumika Bayer Urethane Co., Ltd.): 80 parts Resin (Sumidur BL3175 manufactured by Sumika Bayer Urethane Co., Ltd.): 20 parts Comparative Examples 1 to 5

Each comparative charging member (charging roll) is obtained in the same manner as in Example 1, except that a type and an amount of the resin, and a type and an amount of unevenness-imparting particles are changed in accordance with Table 1.

Measurement/Evaluation

Evaluation with respect to the charging members (charging rolls) obtained in each example is performed as follows.

Evaluation of Stripe-Shaped Image Defect

The charging member (charging roll) obtained in each example is mounted on the process cartridge of DocuCentre SC2021 CPS manufactured by Fuji Xerox Co., Ltd. In addition, the process cartridge is mounted on DocuCentre SC2021 CPS manufactured by Fuji Xerox Co., Ltd, and an image quality evaluation test is performed. In addition, a charging method to an electrophotographic photoreceptor of the machine is a DC contact charging method of applying only a DC voltage to the charging member and charging the surface of the electrophotographic photoreceptor.

In the evaluation test, under an environment of 25° C. and 85 RH %, before and after continuously printing 80,000 image patterns having image average density of 5% on an A4 paper sheet, 25% halftone image is formed on entire surface, and evaluation is performed regarding a stripe-shaped image defect (a color stripe which is formed along an axial direction of the photoreceptor) having a length of 2 mm or more formed within a range of 50×50 mm of a center portion of a halftone image, based on the following standard. The evaluation result is shown in Table 1.

Evaluation of Image Defect of Color Stripe

A: Color stripe are not found.

B: 1 to 2 color stripes are formed.

C: 3 to 10 color stripes are formed.

D: 11 to 20 color stripes are formed.

E: 21 to 29 color stripes are formed (a level which has a problem in practical use)

F: 30 or more color stripes are formed (a level which has a problem in practical use)

TABLE 1

| | Resin | | Unevenness-imparting particles | | | | | | | | | | Outermost layer | | Evaluation Stripe-shaped image defect | |
|---|---|---|---|---|---|---|---|---|---|---|---|---|---|---|---|---|
| | Type | Number of parts | Type | Number of parts | Ratio of large diameter side deformed particles (% by number) | Ratio of large diameter side spherical particles (% by number) | Ratio of small diameter side deformed particles (% by number) | Ratio of small diameter side spherical particles (% by number) | D50n (μm) | σ value (μm) | CV value (%) | Film thickness (μm) | Rz (μm) | Before printing 80,000 images | After printing 80,000 images |
| Example 1 | MN | 100 | (1) | 30 | 10 | 90 | 50 | 50 | 3.5 | 2.7 | 77 | 7 | 4.8 | A | B |
| Example 2 | MN | 100 | (2) | 30 | 25 | 75 | 50 | 50 | 4.0 | 2.7 | 68 | 7 | 4.8 | B | C |
| Example 3 | MN | 100 | (3) | 30 | 10 | 90 | 20 | 80 | 4.0 | 2.3 | 58 | 7 | 4.8 | A | B |
| Example 4 | MN | 100 | (4) | 30 | 10 | 90 | 80 | 20 | 6 | 2.9 | 48 | 7 | 5.3 | C | C |
| Example 5 | MN | 100 | (1) | 30 | 10 | 90 | 50 | 50 | 3.5 | 2.7 | 77 | 5 | 5.1 | A | A |
| Example 6 | MN | 100 | (1) | 30 | 10 | 90 | 50 | 50 | 3.5 | 2.7 | 77 | 3 | 6.2 | A | A |
| Example 7 | MN | 100 | (2) | 30 | 25 | 75 | 50 | 50 | 4.0 | 2.7 | 68 | 5 | 5.5 | B | B |
| Example 8 | MN | 100 | (5) | 30 | 10 | 90 | 50 | 50 | 1.8 | 1.9 | 106 | 7 | 2.2 | C | D |
| Example 9 | MN | 100 | (6) | 30 | 10 | 90 | 50 | 50 | 22 | 6 | 27 | 7 | 18 | B | D |
| Example 10 | MN | 100 | (7) | 30 | 25 | 75 | 50 | 50 | 4.0 | 2.7 | 68 | 7 | 5 | C | D |
| Example 11 | MN | 100 | (8) | 30 | 25 | 75 | 50 | 50 | 4.0 | 2.7 | 68 | 7 | 4.6 | C | D |
| Example 12 | AC | 100 | (1) | 30 | 10 | 90 | 50 | 50 | 4.0 | 2.7 | 68 | 7 | 4.8 | B | D |
| Comparative example 1 | MN | 100 | (C1) | 30 | 10 | 90 | 50 | 50 | 15 | 2.7 | 18 | 7 | 21 | B | E |
| Comparative example 2 | MN | 100 | (C2) | 5 | 10 | 90 | 50 | 50 | 1.5 | 1.3 | 87 | 7 | 1.8 | E | F |
| Comparative example 3 | MN | 100 | (C3) | 30 | 35 | 65 | 50 | 50 | 4.2 | 2.8 | 67 | 7 | 5.2 | C | E |
| Comparative example 4 | MN | 100 | (C4) | 30 | 10 | 90 | 15 | 85 | 3.8 | 1.2 | 32 | 7 | 5 | E | E |
| Comparative example 5 | MN | 100 | (C5) | 30 | 10 | 90 | 90 | 10 | 3.8 | 3.2 | 84 | 7 | 5.3 | D | F |

From the above-described result, it is ascertained that the stripe-shaped image defect is prevented from the time before printing 80,000 images patterns until the time after printing 80,000 images patterns in the examples, compared to comparative examples.

In addition, detailed meaning of expression in Table 1 is as follows.

Ratio of large diameter side deformed particles: ratio of the large diameter side deformed particles (particles having a particle diameter of 5.0 μm or more and a circularity of 0.8 or less) to the total number of large diameter side particles having a particle diameter of 5.0 μm or more Ratio of large diameter side spherical particles: ratio of the large diameter side spherical particles (particles having a particle diameter of 5.0 μm or more and a circularity of more than 0.8 and 1.0 or less) to the total number of large diameter side particles having a particle diameter of 5.0 μm or more Ratio of small diameter side deformed particles: ratio of the small diameter side deformed particles (particles having a particle diameter of less than 5.0 μm and a circularity of 0.8 or less) to the total number of small diameter side particles having a particle diameter of less than 5.0 μm Ratio of small diameter side spherical particles: ratio of the small diameter side spherical particles (particles having a particle diameter of less than 5.0 μm and a circularity of more than 0.8 and 1.0 or less) to the total number of small diameter side particles having a particle diameter of less than 5.0 μm D50n: number average particle diameter σ value: standard deviation of a particle diameter based on the number CV value: coefficient of variation (CV) value Rz: ten-point average surface roughness Rz MN: N-methoxymethylated nylon "F30K manufactured by Nagase ChemteX Corporation"

AC: acrylic resin mixture (composition thereof is as described above)

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging member, comprising:

a conductive base material; and a conductive outermost layer provided on the conductive base material, wherein the conductive outermost layer has a ten-point average surface roughness Rz of 2 μm to 20 μm and contains a resin and particles in which particles having a particle diameter of 5.0 μm or more and a circularity of 0.8 or less are 30% by number or less with respect to the total number of particles having a particle diameter of 5.0 μm or more, and particles having a particle diameter of less than 5.0 μm and a circularity of 0.8 or less are from 20% by number to 80% by number with respect to the total number of particles having a particle diameter of less than 5.0 μm.

2. The charging member according to claim 1, wherein the conductive outermost layer contains 20% by number or less of particles having a particle diameter of 5.0 μm or more and a circularity of 0.8 or less among the particles with respect to the total number of particles having a particle diameter of 5.0 μm or more.

3. The charging member according to claim 2, wherein the conductive outermost layer further contains 80% by number or more of particles having a particle diameter of 5.0 μm or more and a circularity of more than 0.8 and 1.0 or less among the particles with respect to the total number of particles having a particle diameter of 5.0 μm or more.

4. The charging member according to claim 1, wherein the conductive outermost layer contains from 30% by number to 70% by number of particles having a particle diameter of less than 5.0 μm and a circularity of 0.8 or less among the particles with respect to the total number of particles having a particle diameter of less than 5.0 μm.

5. The charging member according to claim 4, wherein the conductive outermost layer further contains from 30% by number to 70% by number of particles having a particle diameter of less than 5.0 μm and a circularity of more than 0.8 and 1.0 or less among the particles with respect to the total number of particles having a particle diameter of less than 5.0 μm.

6. The charging member according to claim 1, wherein, among the particles, particles having a particle diameter of 5.0 μm or more and a circularity of 0.8 or less have a circularity of 0.2 or more.

7. The charging member according to claim 1, wherein, among the particles, particles having a particle diameter of less than 5.0 μm and a circularity of 0.8 or less have a circularity of 0.2 or more.

8. The charging member according to claim 1, wherein a number average particle diameter of the total number of the particles is from 2 μm to 20 μm.

9. The charging member according to claim 1, wherein the particles are polyamide resin particles.

10. The charging member according to claim 1, wherein the resin is a polyamide resin.

11. The charging member according to claim 1, wherein a thickness of the conductive outermost layer is equal to or less than 1.7 times a number average particle diameter of the total number of the particles.

12. A process cartridge that is detachable from an image forming apparatus, comprising:

an image holding member; and a charging device that charges a surface of the image holding member, wherein the charging device includes the charging member according to claim 1, and the charging member is provided being in contact with or proximate to the surface of the image holding member.

13. An image forming apparatus, comprising:

an image holding member;

a charging device that charges a surface of the image holding member;

a latent image forming device that forms a latent image on the charged surface of the image holding member;

a developing device that develops the latent image formed on the surface of the image holding member by a toner to form a toner image; and a transfer device that transfers the toner image formed on the surface of the image holding member onto a recording medium, wherein the charging device includes the charging member according to claim 1, and the charging member is provided being in contact with or proximate to the surface of the image holding member.

14. The image forming apparatus according to claim 13, wherein the surface of the image holding member is charged by applying a DC voltage to the charging member.

* * * * *